US011203819B1

(12) United States Patent
Moujdin et al.

(10) Patent No.: US 11,203,819 B1
(45) Date of Patent: Dec. 21, 2021

(54) METHOD OF FORMING POLYMER HOLLOW FIBER

(71) Applicant: King Abdulaziz University, Jeddah (SA)

(72) Inventors: Iqbal Ahmed Moujdin, Jeddah (SA); Rosli Bin Mohd Yunus, Jeddah (SA)

(73) Assignee: King Abdulaziz University, Jeddah (SA)

( * ) Notice: Subject to any disclaimer, the term of this patent is extended or adjusted under 35 U.S.C. 154(b) by 0 days.

(21) Appl. No.: 17/460,841

(22) Filed: Aug. 30, 2021

Related U.S. Application Data

(62) Division of application No. 17/198,413, filed on Mar. 11, 2021, now Pat. No. 11,142,849.

(51) Int. Cl.
*D01F 1/08* (2006.01)
*D01D 5/24* (2006.01)
*D01D 4/02* (2006.01)

(52) U.S. Cl.
CPC ..... *D01F 1/08* (2013.01); *D01D 4/025* (2013.01); *D01D 5/24* (2013.01)

(58) Field of Classification Search
CPC . D01F 1/08; D01D 5/24; D01D 4/025; D01D 4/02
See application file for complete search history.

(56) References Cited

U.S. PATENT DOCUMENTS 5,318,417 A 6/1994 Kopp
7,691,318 B2 4/2010 Moore

FOREIGN PATENT DOCUMENTS

CN 103314140 B 12/2016

OTHER PUBLICATIONS

Feng, et al. ; Recent progresses in polymeric hollow fiber membrane preparation, characterization and applications ; Separation and Purification Technology 111 ; pp. 43-71 ; Mar. 20, 2013 ; 29 Pages.

*Primary Examiner* — Marc C Howell
*Assistant Examiner* — John J DeRusso
(74) *Attorney, Agent, or Firm* — Oblon, McClelland, Maier & Neustadt, L.L.P.

(57) ABSTRACT

A multi-angle spinneret for forming hollow fibers is provided. The multi-angle spinneret includes a body defining a dope chamber, a bore needle channel, and multiple dope channels being oriented at a minimum of two distinct dope channel angles relative to the dope chamber. The body includes a bore needle disposed in the bore needle channel and oriented substantially perpendicular relative to the dope chamber. The bore needle extends though the dope chamber, such that a bore fluid flow through the bore needle is kept separate from a dope flow through the dope channels. A bore fluid outlet is positioned within a dope outlet of the dope chamber, such that a bore fluid flow out of the bore fluid outlet is substantially coaxial with and substantially centered within a dope flow out of the dope outlet.

5 Claims, 4 Drawing Sheets

METHOD OF FORMING POLYMER HOLLOW FIBER

CROSS-REFERENCE TO RELATED APPLICATIONS

The present application is a Divisional of U.S. application Ser. No. 17/198,413, now allowed, having a filing date of Mar. 11, 2021.

BACKGROUND OF THE INVENTION

Field of the Invention

The present disclosure relates to a hollow fiber, and, more particularly relates, to a multi-angle spinneret and a method for forming the hollow fiber using the multi-angle spinneret.

Discussion of the Background

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Use of hollow fibers in various applications is well known. For example, hollow fibers are used in carpets, as fill materials for pillows, as insulation materials for blankets and garments, and as membranes for gas separation, blood dialysis, purification of water, and other filtering applications. A common method of fabrication of the hollow fibers involves the spinning of polymer solutions to form fibers. Spinning can be viewed as a specialized form of extrusion in which a liquid containing a polymer is extruded through a device known as a spinneret which is configured to form the polymer into fibers. Spinning methods are typically divided into three categories: melt spinning, dry spinning, and wet spinning. Melt spinning is typically reserved for techniques in which the polymer to be spun into a fiber is heated until melting, then the molten polymer liquid is extruded through the spinneret. Dry spinning and wet spinning are distinct from melt spinning in that the polymer used to form the fiber is mixed with a solvent to form the liquid to be extruded. This liquid is commonly referred to as "dope". In dry spinning, the polymer solution is extruded into a heated tubular shaft, where the solvent evaporates gradually, so that a substantially dry fiber exits from the shaft. Wet spinning, in contrast, involves extruding the polymer solution through the spinneret into a coagulation bath, where the polymer hardens and solvents are washed off with suitable liquids, such as water. To form hollow fibers, these spinning methods are typically modified such that the extruded polymer is prevented from collapsing to form a solid fiber. One such modification is the inclusion of a $2^{nd}$ liquid co-extruded through the spinneret in which the polymer is not soluble, referred to as a "bore". The use of a bore requires specially-designed spinnerets capable of co-axially extruding the dope and bore simultaneously. Such spinnerets typically include a means for supplying bore fluid which is positioned in the spinning orifice for forming bore of the hollow fiber.

While conceptually simple, these spinning processes are complex and frequently require an enormous amount of experimentation to optimize in order to produce fibers with desired characteristics. Some of the factors which must be controlled include the polymer selection, the dope solvent selection, the dope solvent concentration, the bore liquid selection, the rates of dope and bore extrusion, the air gap length between the spinneret and the coagulation bath in wet spinning, the extrusion temperature, the coagulation temperature, and the extrusion pressure. [Kapantaidakis, G. C., Koops, G. H., and Wessling, M., Effect of spinning conditions on the structure and the gas permeation properties of high flux polyethersulfone/polyimide blend hollow fibers. Desalination 144 (2002) 121-125; Khayet, M., Cojocaru, C., Essalhi, M., García-Payo, M. C., and Arribas, P., García-Fernández, L., Hollow fiber spinning experimental design and analysis of defects for fabrication of optimized membranes for membrane distillation. Desalination 287 (2012) 146-158; and Ahmad, A. L., Otitoju, T. A., Ooi, B. S., Hollow fiber (HF) membrane fabrication: A review on the effects of solution spinning conditions on morphology and performance. Journal of Industrial and Engineering Chemistry 70 (2019) 35-50]

It is well-understood in the art that regardless of the type of spinning performed, the spinneret itself plays a critical role in extrusion process and thus the properties of the spun hollow fibers. Spinnerets may include devices or components for achieving a well-regulated spinning process. Examples of such devices and components include hardware for ensuring uniform supply of dope, hardware for ensuring independent control of dope and bore extrusion rates, precisely sized and shaped orifices, shaped dope chambers, dope mixing hardware, and heaters or coolers to regulate temperatures to regulate the spinning process. See, for example, U.S. Pat. No. 7,691,318B2 and Chinese Patent CN103314140B. Such regulation and control are necessary to produce identical hollow fibers with desired characteristics or measurements such as diameter, composition, pore size, and concentricity. Multiple spinning assemblies have been devised for purpose of production of the hollow fibers.

The flow of dope within the spinneret is one such important factor for controlling the spinning process. Pereira, et. al. found that the viscosity of the dope can impact the structure of spun hollow fibers, particularly by changing the flow characteristics through the spinneret orifice and the subsequent die-swell phenomenon [Pereira, C. C., Nobrega, R., and Borges, C. P., Spinning process variables and polymer solution effects in the die-swell phenomenon during hollow fiber membranes formation, Brz. J. Chem. Eng. 17 (2000) 4-7]. It has been shown that the angle at which the dope flows within the spinneret can have dramatic effects on the resultant fiber. For example, Wang, et. al. demonstrated that poly(ethersulfone) hollow fibers extruded with a spinneret having a 90° dope flow angle were markedly different from those extruded using a spinneret having a 60° dope flow angle. [Wang, K. Y., Matsuura, T., Chung, T. S. and Guo, W. F., The effects of flow angle and shear rate within the spinneret on the separation performance of poly(ethersulfone) (PES) ultrafiltration hollow fiber membranes. Journal of Membrane Science 240 (2004) 67-79; incorporated by reference in its entirety]. The selection of the dope flow angle is greatly affected by the rheological behavior of the polymeric solution due to development of higher shear stress during extrusion. Moreover, the dope flow angle also affects molecular orientation of the polymer solution, which adds to the shear stress and affects membrane performance of the hollow fiber. [Feng, C. Y., Khulbe, K. C., Matsuura, T. and Ismail, A. F., Recent Progress in Polymeric Hollow Fiber Membrane Preparation, Characterization, and Applications, Separation and Purification Technology, 2013, 111, 43-71]

Current spinnerets like the examples provided by Wang, et. al. are capable of having only a single value for the dope flow angle. Considering that different dope solutions, even ones which contain the same polymer and/or solvent, can have different optimal dope flow angles, a spinneret having more than one dope flow angle represents a significant advantage over a spinneret having only a single dope flow angle.

In view of the foregoing, one objective of the current invention is to provide a multi-angle spinneret having a plurality of dope channels oriented at multiple dope channel angles. Such a spinneret could, for example, greatly increase the scope or speed of optimization experiments or eliminate the need to change spinnerets when slightly altering a spinning process. Also provided is a method of forming a hollow fiber using the multi-angle spinneret. The method may also involve post-coagulation ultrasonic treatment of the fibers and/or circulation, draining, and/or replacing of the coagulant solvent, thereby affecting uniformity in quality of the fibers.

SUMMARY OF THE INVENTION

The present disclosure relates to a multi-angle spinneret that comprises a body and a bore needle. The body comprises a dope chamber having an upper chamber opening and a lower chamber opening, a dope outlet connected to the lower chamber opening of the dope chamber, and a plurality of dope channels. Each dope channel comprises a dope channel inlet and a dope channel outlet. Further, each of the dope channels is oriented at a dope channel orientation angle measured relative to a plane defined by the upper chamber opening of the dope chamber. The body also comprises a bore needle channel extending from an exterior surface of the body to the upper chamber opening of the dope chamber. The bore needle channel comprises a bore needle connection located at a surface end of the bore needle channel and a bore needle channel termination located at a dope chamber end of the bore needle channel. The bore needle channel is oriented substantially perpendicular to a plane defined by the upper chamber opening of the dope chamber. The bore needle comprises a bore fluid inlet and a bore fluid outlet. The bore needle is connected to the bore needle connection and is disposed in the bore needle channel. With such arrangement, the bore needle extends though the dope chamber, such that a bore fluid flow through the bore needle is kept separate from a dope flow through the dope chamber. Further, the bore fluid outlet is positioned substantially within the dope outlet, such that a bore fluid flow out of the bore fluid outlet is substantially coaxial with and substantially centered within a dope flow out of the dope outlet. The plurality of dope channels comprises dope channels oriented at a minimum of two distinct dope channel angles.

In some embodiments, the dope channel angles are at least two selected from the group consisting of 90° to greater than 75°, 75° to greater than 52.5°, 52.5° to greater than 37.5°, and 37.5° to 15°.

In some embodiments, the plurality of dope channels comprises dope channels oriented at a minimum of three dope channel angles.

In some embodiments, the dope channel angles are at least three selected from the group consisting of 90° to greater than 75°, 75° to greater than 52.5°, 52.5° to greater than 37.5°, and 37.5° to 15°.

In some embodiments, the plurality of dope channels comprises at least two dope channels oriented at each distinct dope channel angle.

In some embodiments, a dope inflow through a dope channel enters the dope chamber at a dope entrance angle that is substantially the same as the dope channel orientation angle of the dope channel through which the inflow passes.

In some embodiments, the dope chamber has a tapered shape, having a ratio of an upper chamber opening area to a lower chamber opening area of 12:1 to 3:1.

In some embodiments, the body comprises an upper body and a lower body. The upper body comprises the bore needle channel, the bore needle, and the plurality of dope channels. The lower body comprises the dope chamber and dope outlet.

In some embodiments, the multi-angle spinneret further comprises a gasket located between the upper body and the lower body.

In some embodiments, the multi-angle spinneret is configured to receive, at the bore fluid inlet and extrude through the bore fluid outlet, a bore fluid at a bore fluid pressure above ambient atmospheric pressure and/or receive, at the dope channel inlets and extrude through the dope outlet, a dope at a dope pressure above ambient atmospheric pressure.

The present disclosure relates to a method of forming a hollow fiber. The method comprises extruding through the multi-angle spinneret a dope and a bore fluid to form an uncured fiber. The dope comprises a polymer and a dope solvent. The bore fluid comprises a bore solvent. The method comprises treating the uncured fiber to form the hollow fiber.

In some embodiments, an extrusion force for extruding the dope and/or the bore fluid is provided by a compressed gas.

In some embodiments, the dope and bore fluid are extruded through the multi-angle spinneret into a first coagulation bath comprising a conical or trapezoidal coagulation bath container and a first coagulation solution.

In some embodiments, the first coagulation solution comprises a solvent for the polymer in the dope and an anti-solvent for the polymer in the dope.

In some embodiments, the first coagulation solution is continuously drained from and added to the first coagulation bath, such that a volume of the first coagulation solution in the conical or trapezoidal coagulation bath container does not change during the extruding.

In some embodiments, the first coagulation solution is continuously drained from and added to the first coagulation bath, such that a composition of the first coagulation solution does not change during the extruding.

In some embodiments, the first coagulation solution is circulated in the conical or trapezoidal coagulation bath container in a direction substantially antiparallel to the direction in which the dope and bore are extruded into the first coagulation bath.

In some embodiments, the dope and bore fluid extruded through the multi-angle spinneret pass through an air gap between the multi-angle spinneret and the first coagulation bath before entering the first coagulation bath.

In some embodiments, the step of treating the uncured fiber to form the hollow fiber comprises ultrasonicating.

In some embodiments, the step of treating the uncured fiber to form the hollow fiber comprises washing the uncured fiber.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION OF THE INVENTION

In the following description, it is understood that other embodiments may be utilized, and structural and operational changes may be made without departure from the scope of the present embodiments disclosed herein.

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
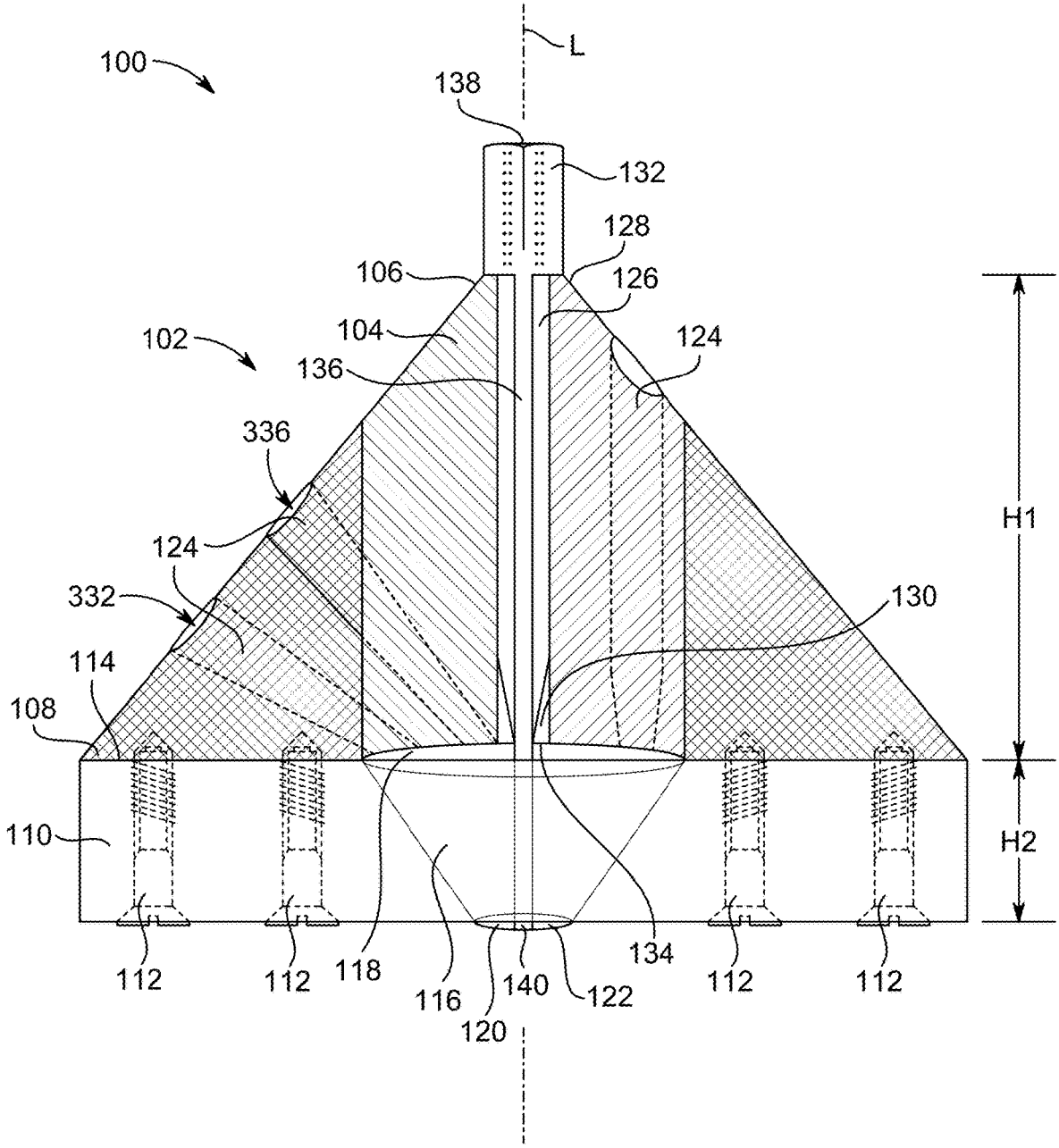
FIG. 1 illustrates a multi-angle spinneret, according to an embodiment of the present disclosure.

FIG. 1 illustrates a multi-angle spinneret 100, hereinafter referred to as "the spinneret 100", according to an embodiment of the present disclosure. The spinneret 100 includes a body 102. In some embodiments, the body 102 is a two-part body, having an upper body 104 extending between a first end 106 and a second end 108, and a lower body 110 extending from the second end 108 of the upper body 104. An example of such an embodiment is provided in FIG. 1. In some embodiments the upper body 104 has a tapered or triangular cross-section and the lower body 110 is attached to one edge of the triangular cross-section. It should be understood that this cross-sectional shape is compatible with a multitude of overall three dimensional shapes including cones, triangular-based pyramids, square-based pyramids, and triangular prisms. In general, the lower body 110 may be attached or secured to the upper body 104 by any suitable means known to a person of ordinary skill in the art. In some embodiments, the lower body 110 is fastened to the upper body 104 with aid of rivets, breakaway screws, security screws, or other non-removable coupling implement. In some embodiments, the lower body 110 is fastened to the upper body 104 with aid of screws, fasteners, snap-fittings, or other removable coupling implement 112. In such embodiments, the lower body 110 may be removed or uncoupled from the upper body 104 by removal of said coupling implement(s). In some embodiments, the lower body 110 is attached to the upper body 104 using multiple fasteners 112. In some embodiments, the lower body 110 and the upper body 104 have appropriate features to allow the coupling of the lower body 110 and the upper body 104 using the fasteners 112. Examples of such features include attachment points for snap fittings, channels, threads, and openings. In some embodiments, the upper body 104 and/or the lower body 110 comprise alignment facilitating features. Such features are useful for ensuring and maintaining proper alignment of the upper body 104 and the lower body 110, and may work together with the fasteners 112 to allow or facilitate coupling of the upper and lower bodies. Examples of such alignment features include nesting complementary protrusions and indentations, rail and channel systems, and magnetic features. In some embodiments, a single upper body 102 may be configured to be used with any of a set of lower bodies 110 having different proportions, dimensions, or components as described below. In alternative embodiments, the body 102 is a one-piece body.

In preferred embodiments, a size of the upper body 104 is larger than a size of the lower body 110. Specifically, a height "H1" of the upper body 104 is greater than a height "H2" of the lower body 110. In general, the spinneret 100 may be fabricated of any suitable material known to one of ordinary skill in the art. The material of which the spinneret is fabricated should preferably be able to withstand the spinning process without loss of mechanical integrity, degradation, or other damage or disadvantageous change in structure (such as swelling, shrinking, or cracking). Such a material should be chemically and mechanically resistant to factors such as the dope and its components, the bore and its components, and the temperature of the spinning process. In preferred embodiments, the spinneret 100 is fabricated using a metal. In some embodiments, the spinneret 100 may be fabricated using stainless steel, and particularly high corrosive resistance grade stainless steel. In some embodiments, the spinneret 100 may include a gasket 114 located between the upper body 104 and the lower body 110. The gasket 114 may be made of any suitable material known to one of ordinary skill in the art. Examples of such materials include, but are not limited to plastics, fluoropolymers such as PTFE, silicones, rubbers (both natural and artificial), polymer foams, fibrous materials such as cellulose, impregnated cellulose, and fiberglass, felts, and plant materials such as cork. In some embodiments, the gasket is made of a material that can be easily punctured, so that the fasteners 112 may puncture and pass through the gasket 114 as part of the fastening of the lower body 110 with the upper body 104. In alternative embodiments, the gasket has openings through which the fasteners may pass without puncturing the gasket. In some embodiments, the gasket creates a liquid-tight seal between the upper body 104 and the lower body 110. In some embodiments, the gasket creates a gas-tight seal between the upper body 104 and the lower body 110. Preferably, the gasket does not cover any portion of the dope chamber or in any way impede a flow of dope and/or bore through the spinneret.

The body 102 includes a dope chamber 116 having an upper chamber opening 118 and a lower chamber opening 120. In some embodiments, the dope chamber has a tapered shape. In some embodiments, the dope chamber 116 is defined in the lower body 110. In some embodiments, the upper chamber opening 118 coincides with a top surface of the lower body 110. In such embodiments, the As shown in FIG. 1, the dope chamber 116 is embodied as a frustum-conical shaped cavity tapering towards the lower chamber opening 120. In some embodiments, the dope chamber 116 may be embodied as a frustum-pyramid shaped cavity. In some embodiments, a ratio of an upper chamber opening area to a lower chamber opening area may be 12:1 to 3:1, preferably 11:1 to 3.5:1, preferably 10:1 to 4:1, preferably 9:1 to 4.5:1. The body also includes a dope outlet 122 connected to the lower chamber opening 120 of the dope chamber 116.

In some embodiments, the body 102 comprises a dope drain. In general, the dope drain is a channel, conduit, tube, or other similar means which connects the dope chamber to an exterior surface of the body such that dope may flow out of the dope chamber via the dope drain instead of the dope outlet. The dope drain may be advantageous for removing dope from the dope chamber without having the dope be spun into a hollow fiber. Such removing may be advantageous for stopping a spinning process, either under normal operating circumstances or in extraordinary circumstances such as emergency stops. In preferred embodiments, the dope drain is reversibly blocked by a dope drain blocker. In such embodiments, the dope drain blocker is disposed in the dope drain at a position proximal to the dope chamber. In such embodiments, the dope drain blocker is configured to create a smooth, continuous surface within the dope chamber such that a flow of dope within the dope chamber is not disrupted by the dope drain or the dope drain blocker.

The body 102 further comprises a plurality of dope channels 124. In some embodiments, dope channels 124 are defined in the upper body 104. Each of the dope channels 124 comprises a dope channel inlet and a dope channel outlet. Each of the dope channels 124 is oriented at a dope channel orientation angle, this angle measured relative to a plane defined by the upper chamber opening 118 of the dope chamber 116. As used herein, the "plane defined by the upper chamber opening 118 of the dope chamber 116" may refer to a horizontal plane containing a top surface of the lower body 110 that abuts a bottom surface of the upper body 104 when the lower body 110 is fastened to the upper body 104. In some embodiments, the dope channel orientation angles are at least two selected from the group consisting of 90° to greater than 75°, 75° to greater than 52.5°, 52.5° to greater than 37.5°, and 37.5° to 15°. In some embodiments, the plurality of dope channels 124 may include dope channels 124 oriented at a minimum of three dope channel orientation angles. Accordingly, the dope channel orientation angles are at least three selected from the group consisting of 90° to greater than 75°, 75° to greater than 52.5°, 52.5° to greater than 37.5°, and 37.5° to 15°. In some embodiments, three dope channels 124 may be provided, and the corresponding dope channel orientation angles may be 30°, 45°, and 90°. In some embodiments, the plurality of dope channels 124 may include at least two dope channels 124 oriented at each distinct dope channel orientation angle. As such, a dope inflow through each of the plurality of dope channels 124 enters the dope chamber 116 at a dope entrance angle that is substantially the same as the dope channel orientation angle of the dope channel 124 through which the dope inflow passes.

In some embodiments, the dope channel inlet comprises a dope line connection. The dope line connection may be any suitable feature or hardware known to one of ordinary skill in the art useful for forming a connection between a dope channel inlet and an implement for delivering dope to the dope channel inlet. Examples of such implements for delivering dope to the dope channel inlet include pipes, tubes, conduits, and lines. In some embodiments, the dope line connection comprises threading. In alternative embodiments, the dope line connection comprises a push-to-connect coupling. Examples of push-to-fit couplings include press-fit couplings, snap-fit couplings, and SharkBite® couplings. In some embodiments, the dope line connection forms a liquid-tight seal between the dope line and the dope channel inlet. In some embodiments, the dope line connection forms a gas-tight seal between the dope line and the dope channel inlet. In some embodiments, the dope line connection comprises sealing features for creating a liquid-tight or gas-tight seal, for example gaskets, o-rings, thread-seal tapes, thread-seal liquids, and putties.

In some embodiments, the dope channel outlet comprises a dope channel blocker connection. The dope channel blocker connection may be any suitable feature or hardware known to one of ordinary skill in the art useful for forming a connection between a dope channel outlet and a dope channel blocker. The dope channel blocker is a removable piece of hardware which may be used to block a flow of dope from the dope chamber into a dope channel which is not currently being supplied dope. The dope channel blocker, in this sense, may be similar to a plug for unused dope channels which prevents undesirable dope flow or flows within the spinneret. In general, the dope channel blocker may be any suitable material known to one of ordinary skill in the art. In some embodiments, the dope channel blocker is constructed of the same material as the body 102 or upper body 104. In some embodiments, the dope channel blocker comprises threading. In such embodiments, the dope channel blocker connection similarly comprises threading, the threading of the dope channel blocker connection being configured to interface with the threading of the dope channel blocker. In alternative embodiments, the dope channel blocker connection comprises a push-to-fit coupling as described above.

In general, the dope channels 124 may be fabricated in the body 102 or upper body 104 by any suitable method known by one of ordinary skill in the art. In some embodiments, the dope channels 124 are formed in the body 102 or upper body 104 during the construction or formation of the body 102 or upper body 104. For example, in embodiments where the body 102 or upper body 104 is made by casting or molding, the dope channels 124 may be included in the cast or mold such that they are formed simultaneously with the rest of the body 102 or upper body 104. Alternatively, the dope channels 124 may be formed after the construction or formation of the body 102 or upper body 104. In such embodiments, the dope channels 124 may be formed in the body 102 or upper body 104 by any suitable method known by one of ordinary skill in the art. For example, the dope channels 124 may be drilled through the upper body 104 by orienting drill bits inclined at respective angles to the plane defined by the upper chamber opening 118 of the dope chamber 116. In another example, laser drilling may be employed to form the dope channels 124.

The body 102 further includes a bore needle channel 126 extending from an exterior surface 128 of the body 102 to the upper chamber opening 118 of the dope chamber 116. In some embodiments, the bore needle channel 126 is formed as a hollow channel extending from the first end 106 of the upper body 104 to the second end 108 of the upper body 104. In such embodiments, when the lower body 110 is secured to the upper body 104, an end 130 of the bore needle channel 126 at the second end 108 of the upper body 104 is disposed in fluid communication with the dope chamber 116. In general, the bore needle channel 126 may be fabricated in the body 102 or upper body 104 by any suitable method known by one of ordinary skill in the art. In some embodiments, the bore needle channel 126 is formed in the body 102 or upper body 104 during the construction or formation of the body 102 or upper body 104 as described above. Alternatively, the bore needle channel 126 may be formed after the construction or formation of the body 102 or upper body 104 as described above. The bore needle channel 126 should not intersect or otherwise interfere with the dope channels 124. The dope channels 124 should not permit dope to flow into the bore needle channel 126.

The bore needle channel 126 includes a bore needle connection 132 located at a surface end of the bore needle channel 126. In FIG. 1, the bore needle connection 132 is embodied as a protrusion extending along a longitudinal axis "L" of the spinneret 100 from the first end 106 of the upper body 104. In some embodiments, the bore needle connection 132 comprises threading. In some embodiments, the bore needle connection 132 comprises a bore needle height adjustment mechanism. The bore needle height adjustment mechanism allows for changing the positioning of a bore needle 132 disposed in the bore needle channel 126. The bore needle channel 126 also includes a bore needle channel termination 134 located at a dope chamber end of the bore needle channel 126. The bore needle channel termination 134 is disposed in fluid communication with the dope chamber 116 as shown in FIG. 1. Further, the bore needle channel 126 is oriented substantially perpendicular to a plane defined by the upper chamber opening 118 of the dope chamber 116. As used herein, the "plane" may refer to a horizontal plane containing the upper chamber opening 118 of the dope chamber 116.

The spinneret 100 further includes a bore needle 136 disposed along the longitudinal axis "L" of the spinneret 100. The bore needle 136 is connected to the bore needle connection 132 and is disposed in the bore needle channel 126. The bore needle 136 includes a bore fluid inlet 138 and a bore fluid outlet 140. In some embodiments, the bore fluid inlet 138 may be formed in the bore needle connection 132. The bore needle 136 extends through the dope chamber 116, such that a bore fluid flow through the bore needle 136 is kept separate from a dope flow through the dope chamber 116. To this end, it is understood that in embodiments having an upper body 104 and a lower body 110, the upper body 104 includes the bore needle channel 126, the bore needle 136, and the plurality of dope channels 124, and the lower body 110 includes the dope chamber 116 and dope outlet 122. The bore needle height adjustment mechanism allows for changing the positioning of the bore needle 136 disposed in the bore needle channel 126 as described above. In some embodiments, the positioning refers to a positioning along the longitudinal axis "L" of the spinneret 100. In some embodiment, the bore needle height adjustment mechanism allows for changing the positioning of the bore fluid outlet 140 along the longitudinal axis "L" relative to the dope outlet 122.

The bore fluid outlet 140 is positioned substantially within the dope outlet 122, such that a bore fluid flow out of the bore fluid outlet 140 is substantially coaxial with and substantially centered within a dope flow out of the dope outlet 122. In such an arrangement, the dope supplied through the dope channels 124 are received in the dope chamber 116 and do not mix with the bore fluid supplied through the bore needle 136. This arrangement may be understood as properly orienting the dope and bore fluid to form a hollow fiber when both the dope and bore fluid are extruded through the spinneret. In general, the arrangement produces a substantially tubular uncured fiber, i.e. a fiber having an exterior portion comprising the dope, the exterior portion surrounding an interior portion comprising the bore. Curing of the polymer contained in the dope and removal of the bore through other processes involved in the method of forming a hollow fiber described below afford the hollow fiber. In general, the extruded hollow fiber can have any suitable cross-sectional shape provided that the extruded fiber be a hollow fiber, i.e. the polymer of the fiber defines and fully encloses an interior space or void. One example of such a fiber is one having a cylindrical tube shape in which the dope or cured polymer and the bore fluid or interior space both have a substantially circular cross-section. In this example, the cross-section of the dope or cured polymer may be viewed as a circular ring enclosing a circular void or bore fluid. A cross-sectional shape of the dope or polymer may be controlled by the shape of the dope outlet 122. A cross sectional-shape of the bore or void may be controlled by the shape of the bore fluid outlet 140. It should be understood that the bore fluid outlet 140 being positioned substantially within the dope outlet 122 refers to the bore fluid outlet 140 having a position along the longitudinal axis "L" of the spinneret 100 substantially the same as the dope outlet 122. In some embodiments, the dope outlet and the bore fluid outlet are coplanar. In some embodiments, the positioning of the bore fluid outlet 140 along the longitudinal axis "L" may be adjusted such that the bore fluid outlet 140 protrudes past the dope outlet 122. For example, the bore fluid outlet 140 may protrude past the dope outlet 122 by 1 mm, 2 mm, 3 mm, 4 mm, 5 mm, or 6 mm.

The present disclosure also relates to a method of forming a hollow fiber. The method comprises extruding through the spinneret 100 a dope and a bore fluid to form an uncured fiber, and treating the uncured fiber to form a hollow fiber. The dope comprises a polymer and a dope solvent. In general, the polymer may be any suitable polymer useful for forming a hollow fiber or which may be of particular use when in the form of a hollow fiber known to one of ordinary skill in the art. Examples of polymers which may be useful for forming a hollow fiber or which may be of particular use when in the form of a hollow fiber include, but are not limited to cellulose acetate, polyvinylidene difluoride (PVDF), poly(ethersulfone) (PES), poly(benzimidazole) (PBI), polyetherimide (PEI, also Ultem®), polyethylene, polypropylene, polyetherketone, polyaniline, poly(tetrafluoroethylene), poly(4-methyl-1-pentene), polyacrylonitrile, poly(4-vinylpyridine), poly(1,5-naphthalene-2,2'-bis(3,4-phthalic)hexafluoropropane diimide), polydimethylsiloxane (PDMS), polyhexafluoropropylene, polyphenylene oxide (PPO), poly(bisphenol-A sulfone), polysulfone (PSF), polyphenylenesulfone (PPSU), polyamide-imide (TORLON®), and polyimide (Matrimid®). In general, the dope solvent may be any suitable solvent useful for forming a dope with a selected polymer or polymers known to one of ordinary skill in the art. Examples of dope solvents include, but are not limited to N-methyl pyrrolidone, dimethyl formamide, dimethyl acetamide, dimethyl sulfoxide, tetrahydrofuran, dioxane, methylene chloride, chloroform, methyl acetate, ethyl acetate, methanol, ethanol, and mixtures thereof. In general, the dope may further comprise additives known to one of ordinary skill in the art. Such additives may be added to the dope solvent, the polymer, or both. Examples of additives which may be used with the dope include, but are not limited to polymer crosslinkers, plasticizers, stabilizers, lubricants, flame retardants, fiber fillers, dyes or other colorant, antimicrobial agents, and antistatic agents.

The bore fluid comprises a bore solvent. Since the bore fluid functions to prevent the hollow fiber from collapsing to form a solid fiber lacking a void or space, the bore solvent it typically a solvent in which the polymer or polymers in the dope are not soluble. In some embodiments, the bore fluid comprises both a first solvent in which the polymer or polymers are soluble and a second solvent in which the polymer or polymers are not soluble (sometimes referred to as a nonsolvent or an anti-solvent). In some embodiments, the bore fluid acts as a coagulant for the polymer in the dope. In general, the bore solvent may be any suitable bore solvent known to one of ordinary skill in the art. Examples of bore solvents include, but are not limited to water, sodium chloride brine, ethanol, methanol, isopropanol, ethylene glycol, propylene glycol, N-methyl pyrrolidone, polyethylene glycol, and mixtures thereof.

In some embodiments, the bore fluid is extruded through the bore fluid outlet 140 at a bore fluid pressure above ambient atmospheric pressure. In some embodiments, the dope is extruded through the dope outlet 122 at a dope pressure above ambient atmospheric pressure. In some embodiments, an extrusion force for extruding the dope and/or the bore fluid is provided by a compressed gas. In some embodiments, the dope may also be supplied through the dope channels 124 under predefined pressure. In some embodiments, the dope is supplied through the dope channels 124 at a particular rate. In general, the dope may be supplied to the dope channels 124 using any suitable method or with any suitable hardware known to one of ordinary skill in the art. Examples of such methods or hardware include gear pumps, syringe pumps, and screw pumps. Upon exit through the dope outlet 122, the bore fluid lies substantially at center of the dope flowing out of the dope outlet 122. The combination of the bore fluid and the dope extruded through the dope outlet 122 constitutes an uncured hollow fiber. In some embodiments, the bore fluid is extruded through the spinneret at an adjustable bore fluid extrusion rate. In some embodiments, the dope is extruded through the spinneret at an adjustable dope extrusion rate. In some embodiments, the bore fluid extrusion rate is equal to the dope extrusion rate. In alternative embodiments, the bore fluid extrusion rate is not equal to the dope extrusion rate. In such embodiments, the method maintains a ratio of the bore fluid extrusion rate to the dope extrusion rate of 10:1 to 1:10, preferably 9:1 to 1:9, preferably 8:1 to 1:8, preferably 7:1 to 1:7, preferably 6:1 to 1:6, preferably 5:1 to 1:5, preferably 4:1 to 1:4, preferably 3:1 to 1:3. The dope extrusion rate and the bore fluid extrusion rate may be measured by any suitable rate measurement known to one of ordinary skill in the art, such as mass per unit time or volume per unit time.

Figure 2:
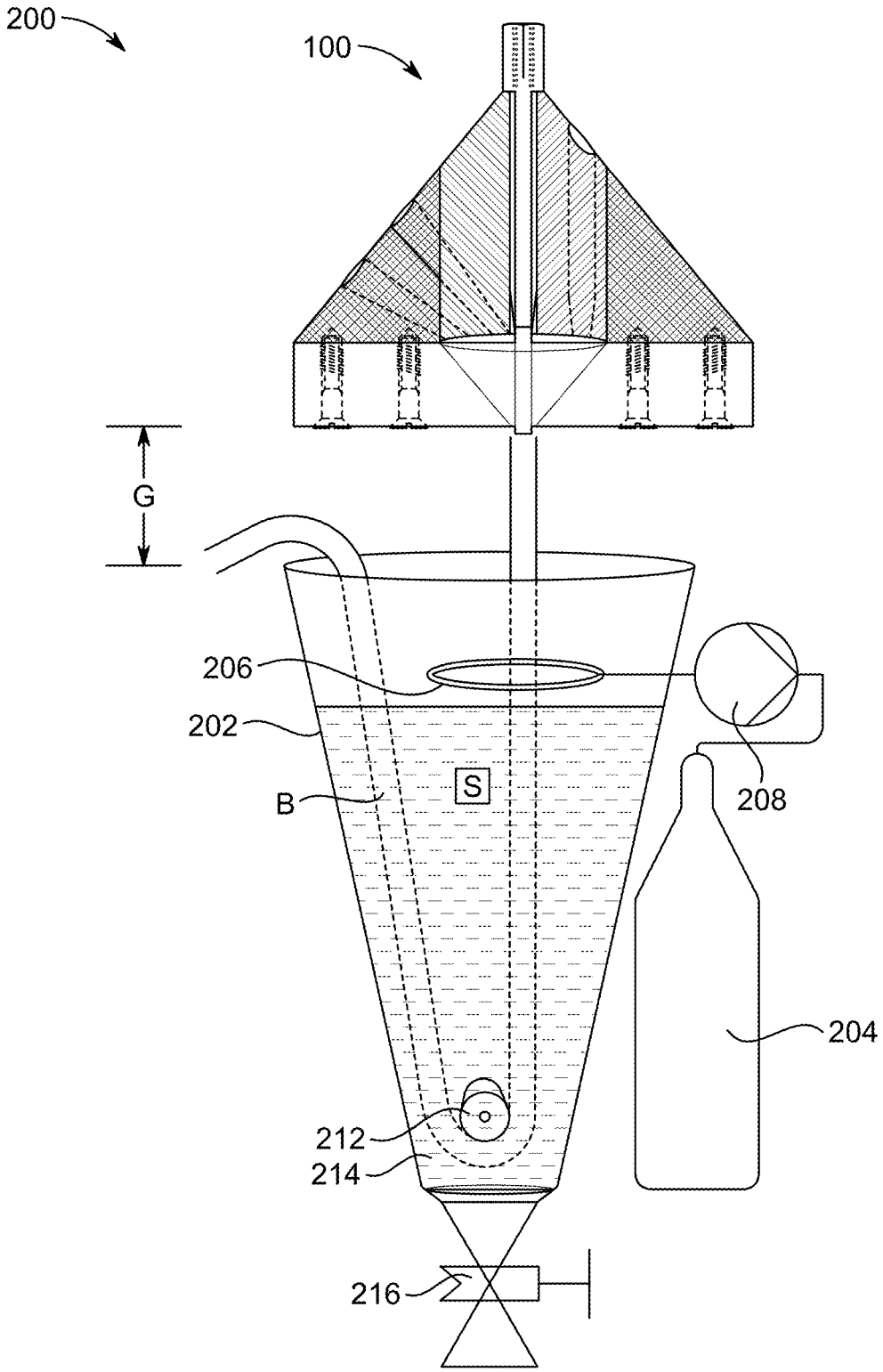
FIG. 2 illustrates a hollow fiber spinning setup showing a hollow fiber being produced by the multi-angle spinneret and being extruded into a coagulation bath, according to an embodiment of the present disclosure.

In some embodiments, the dope and bore fluid are extruded into a first coagulation bath containing a first coagulation solution. The extruded dope and bore fluid may, after extruding, be referred to as an "uncured fiber". FIG. 2 illustrates a setup 200 of a first coagulation bath for the hollow fiber produced by the spinneret 100, according to an embodiment of the present disclosure. The depicted setup 200 includes a conical or trapezoidal first coagulation bath container 202, hereinafter referred to as "the coagulation container 202" configured to contain a first coagulation solution "S", which constitutes the first coagulation bath "B". In general, the first coagulation bath container 202 may be any suitable shape known to one of ordinary skill in the art. In preferred embodiments, the first coagulation bath container 202 has a conical or trapezoidal shape (as depicted in FIG. 2). Such a shape may be advantageous for lessening or minimizing the volume of first coagulation solution necessary for coagulation of the polymer in the extruded dope. In some embodiments, the first coagulation solution "S" comprises a solvent for the polymer or polymers in the dope. In some embodiments, the first coagulation solution comprises an anti-solvent for the polymer or polymers in the dope. In some embodiments, the first coagulation solution comprises both a solvent and an anti-solvent for the polymer or polymers in the dope. In some embodiments, the spinneret 100 is located at a predefined height above the first coagulation container 202, so that the dope and the bore fluid extruded through the spinneret 100 passes through ambient atmosphere before entering the first coagulation bath. This passage through ambient atmosphere is referred to as an air gap "G" present between the spinneret 100 and the first coagulation bath. Specifically, the air gap "G" is defined between the dope outlet 122 of the spinneret 100 and the coagulation container 202. The distance between the dope outlet 122 of the spinneret 100 and the coagulation solution may be referred to as the "air gap distance" or "air gap length".

In some embodiments, the setup 200 includes a storage tank 204 configured to supply the first coagulation solution into the first coagulation bath "B". In some embodiments, the storage tank 204 does not contain the first coagulation solution, instead containing one or more constituent components of the coagulation solution, for example the solvent or the anti-solvent described above. In some embodiments, more than one storage tank is present in the setup 200. In some embodiments, the first coagulation solution or one or more constituent components thereof is supplied to the first coagulation bath through a porous ring 206. In such embodiments, the porous ring is oriented and positioned such that the extruded uncured fiber passes through the porous ring. In some embodiments, the first coagulation solution or the constituent components stored in the storage tank(s) is supplied to the coagulation bath by a dosing pump 208. In some embodiments, the first coagulation solution "S" is circulated through the coagulation container 202. In some embodiments, the first coagulation solution is circulated in a direction substantially antiparallel to the direction in which the dope and the bore fluid are extruded into the first coagulation bath "B". It should be understood that this direction refers to the direction of flow in the vicinity of the uncured fiber and that in other areas of the first coagulation bath, the first coagulation solution may flow in another direction. As depicted in FIG. 2, the first coagulation solution "S" may be circulated in the center of the first coagulation bath in a direction vertically upwards, such that the direction in which the extruded dope and bore fluid are introduced into the coagulation bath is parallel to the direction of circulation of the first coagulation solution "S" in the region of the extruded dope and bore fluid, but in opposite direction.

In some embodiments, the first coagulation container 202 includes a roller 212 at a bottom portion 214 thereof. In such embodiments, the extruded dope and bore fluid is guided around said roller, as shown in FIG. 2, while moving through the first coagulation bath "B". Further, a coagulant solution outlet 216 is provided at the bottom portion 214 of the coagulation container 202. The coagulation solution outlet 216 may be used to drain the first coagulation solution "S" when necessary. In some embodiments, the first coagulation solution "S" may be continuously drained from and replenished to the first coagulation bath "B", such that a volume of the first coagulation solution "S" in the coagulation container 202 does not change while the dope and the bore fluid are extruded into the first coagulation bath "B". In some embodiments, the first coagulation solution "S" may be continuously drained from and added to the first coagulation bath "B", such that a composition of the first coagulation solution "S" does not change while the dope and the bore fluid are extruded into the first coagulation bath "B". Maintaining a constant composition of the first coagulation solution in the first coagulation bath during the coagulation of the extruded dope may be advantageous for achieving enhanced quality and overall performance of the hollow fibers. Further, maintaining the composition and concentration of the first coagulation solution in the first coagulation bath may be advantageous for producing hollow fibers with high uniformity.

The extruded dope and bore fluid are guided out of the coagulation container 202 to constitute a "coagulated fiber". The first coagulation solution may constitute the entirety of or a single step in a curing or treating process for transforming the uncured fiber into the hollow fiber. In some embodiments, the treating further comprises passing the coagulated fiber through a second coagulation bath. In some embodiments, the second coagulation bath is substantially similar to the first coagulation bath. In some embodiments, the second coagulation bath is substantially different from the first coagulation bath. For example, the second coagulation bath may have a second coagulation fluid that is different from the first coagulation solution. Such differences may be, for example, different identities of the solvent and/or anti-solvent or a different ratio of solvent to anti-solvent. The use of any number of such coagulation baths may comprise a "coagulating step" in a curing or treating process for transforming the uncured fiber into the hollow fiber.

In some embodiments, the treating further comprises washing the uncured fiber. In general, the washing may be performed using any suitable method known by one of ordinary skill in the art. In some embodiments, the washing is performed by passing the coagulated fiber or uncured fiber though one or more washing baths. These washing baths preferably contain one or more types of wash liquids. These wash liquids may be intended to remove undesired components from the uncured fiber. In some embodiments, each of the wash liquids can be single liquid or a mixture of liquids or a single liquid of several components that will conveniently coagulate, precipitate, or wash the coagulated fiber or uncured fiber. Examples of components which the wash liquid(s) may comprise include, but are not limited to, water, polar organic solvents, non-polar organic solvents, aprotic or non-aprotic organic solvents, and mixtures thereof. The wash liquids may also contain dissolved or suspended components such as surfactants, aqueous polymers such as PEG, PVP, and PVA, glycerol, dissolved salts, and mixtures thereof. In some embodiments, two or more washing baths are used. In such embodiments, the two washing baths may have substantially the same or substantially different wash liquids. The use of any number of such washing baths may comprise a "washing step" in a curing or treating process for transforming the uncured fiber into the hollow fiber.

In some embodiments, the treating further comprises rinsing the uncured fiber. In general, the rinsing may be performed using any suitable method known by one of ordinary skill in the art. In some embodiments, the rinsing is performed by passing the coagulated fiber or uncured fiber though one or more rinsing baths. These rinsing baths preferably contain one or more types of rinse liquids. These rinse liquids may be intended to remove undesired components from the uncured fiber and/or residual wash liquid or coagulation solution. In general, the rinse liquid may be any liquid as described above. The use of any number of such washing baths may comprise a "rinsing step" in a curing or treating process for transforming the uncured fiber into the hollow fiber.

In some embodiments, the treating further comprises ultrasonication. In some embodiments, the ultrasonicating may be performed simultaneously with any of the coagulation, washing, or rinsing steps. In such embodiments, appropriate hardware for ultrasonication of the uncured fiber within a coagulation bath, washing bath, or rinsing bath may be associated with the appropriate bath. In alternative embodiments, the ultrasonication takes place in a separate ultrasonicating step not associated with the coagulation, washing, or rinsing steps. In such embodiments, the ultrasonication may take place in an ultrasonication bath. Such a bath may comprise an ultrasonication liquid. In general, the ultrasonication liquid can be any suitable liquid known to one of ordinary skill in the art.

Figure 3:
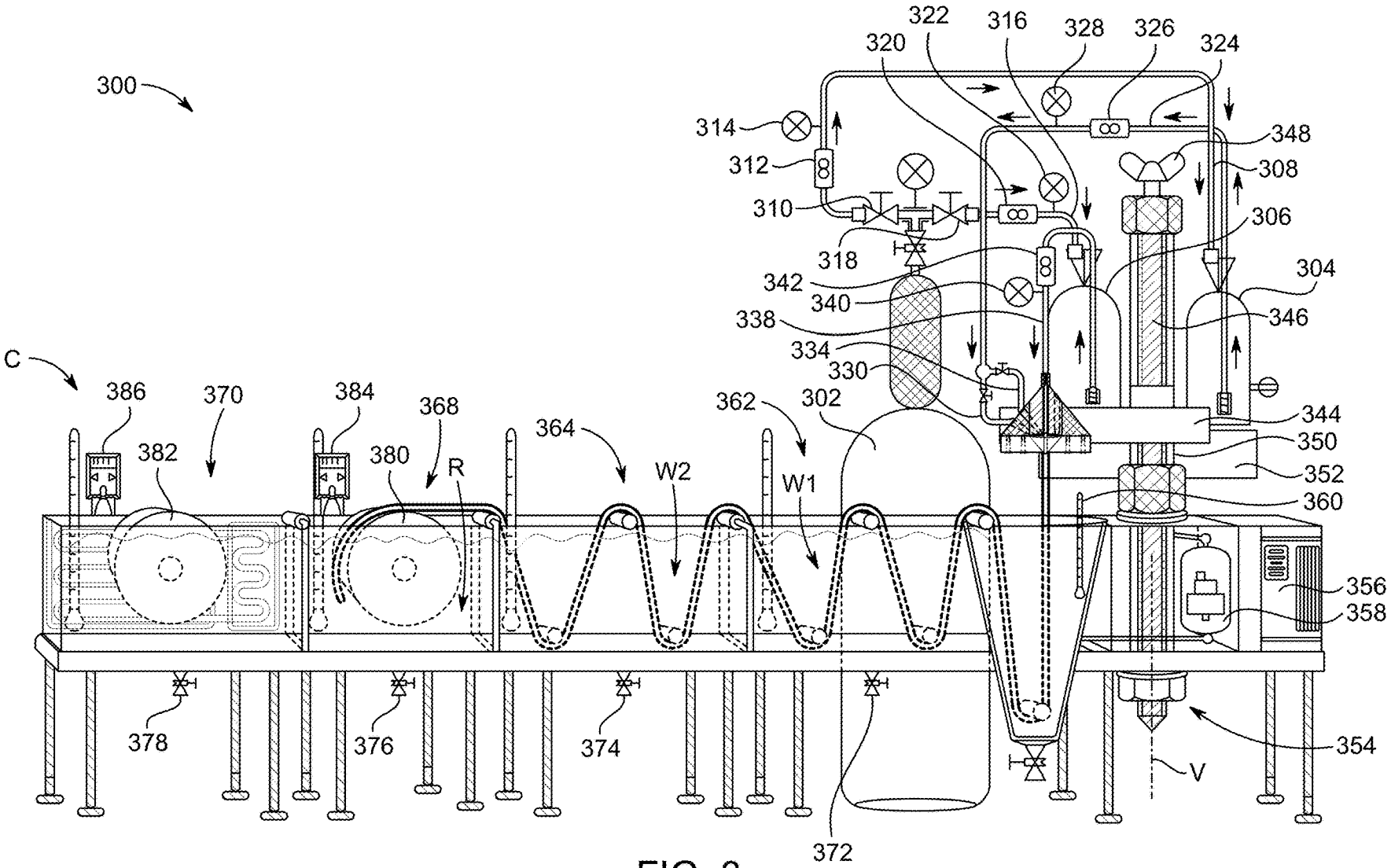
FIG. 3 illustrates a schematic diagram of a method of forming a hollow-fiber, according to an embodiment of the present disclosure.

FIG. 3 illustrates a schematic diagram of an arrangement 300 for spinning of the hollow fiber, according to an embodiment of the present disclosure. The depicted arrangement is intended to convey an arrangement of hardware and equipment for carrying out an exemplary embodiment of the method of the current invention. This exemplary embodiment is one in which the hollow fiber is continuously spun and travels through appropriate stations or containers for carrying out the steps of the method using rollers. The depicted arrangement includes a high-pressure gas cylinder 302, a dope reservoir 304, a bore fluid reservoir 306, and the setup 200 illustrated in FIG. 2. The dope reservoir 304 is in fluid communication with the high-pressure nitrogen cylinder 302 through a first pipe 308, where a first valve 310, a first flow rate controller 312, and a first pressure gauge 314 are connected to the first pipe 308 to control supply of nitrogen to the dope reservoir 304. Similarly, the bore fluid reservoir 306 is in fluid communication with the high-pressure gas cylinder 302 through a second pipe 316, where a second valve 318, a second flow rate controller 320, and a second pressure gauge 322 are connected to the second pipe 316 to control supply of compressed gas to the bore fluid reservoir 306.

Each of the dope reservoir 304 and the bore fluid reservoir 306 are in fluid communication with the spinneret 100. In some embodiments, the dope reservoir 304 is connected to the dope channels 124 through a third pipe 324, where a third flow rate controller 326 and a third pressure gauge 328 are connected to the third pipe 324. In an example, the third flow rate controller 326 may be implemented as a digital flow meter to accurately measure an amount of dope supplied through the third pipe 324 to the spinneret 100. Particularly, the third pipe 324 is depicted as branching at the spinneret 100 to individually connect with the distinct dope channels 124 formed in the spinneret 100. As can be seen in FIG. 3, a first branch 330 of the third pipe 324 connects with a first dope channel 332 (see FIG. 1), i.e., 30° and a second branch 334 of the third pipe 324 connects with a second dope channel 336 (see FIG. 1), i.e., 45°. In this configuration, dope may be supplied to any combination of dope channels 124 at a given time.

Further, the bore fluid reservoir 306 is connected to the bore needle connection 132 through a fourth pipe 338, where a fourth flow rate controller 342 and a fourth pressure gauge 340 are connected to the fourth pipe 338 to manipulate flow of the bore fluid. In this way, the dope and the bore fluid are supplied to the spinneret 100 from the dope reservoir 304 and the bore fluid reservoir 306, respectively.

The spinneret 100 is secured to a platform 344 which is connected to a screw rod 346. In some embodiments, one end of the screw rod 346 includes a knob 348 configured to allow rotation of the screw rod 346, thereby allowing adjustment of the spinneret 100 along a vertical axis "V" and at a desired vertical distance from the coagulation container 202. As such, the air gap "G" between the spinneret 100 and the coagulation container 202 may be set accordingly. The screw rod 346 is coaxially received within an axial rod 350 that is connected to a fixed bed 352. The axial rod 350 extends through a first chamber 354 of a series of chambers "C" provided for treating the hollow fiber.

In some embodiments, the first chamber 354 may measure about 4 ft in width and about 1 ft in height. One portion of the first chamber 354, measuring about 1 ft by 1 ft may house a power supply hub 356 configured to power the entire arrangement 300 of FIG. 3. The first chamber 354 also supports the coagulation container 202. In some embodiments, the coagulation container 202 may measure about 1.5 ft in width at a top opening thereof and about 2 ft in depth. As such, the coagulation container 202 extends below the first chamber 354.

In some embodiments, the first chamber 354 may also house a compressor 358 configured to regulate temperature of the first coagulation solution "S" in the coagulation container 202, and a thermometer 360 to monitor the temperature of the first coagulation solution "S". In some embodiments, the temperature of the first coagulation solution "S" may be maintained at a prescribed temperature, such as, for example, minimum around 5° C.±2° C. The arrangement 300 of FIG. 3 also shows a second chamber 362 containing a washing bath "W1", a third chamber 364 containing another washing bath "W2", a fourth chamber 368 containing a rinsing bath "R", and a fifth chamber 370 for ultrasonic assisted post-treatment of the hollow fiber. Each of the second chamber 362 through the fifth chamber 370 includes a corresponding valve 372, 374, 376, and 378, respectively, located at respective bottom portion thereof to drain fluids from the respective chamber. Liquids stored in the second chamber 362 to the fourth chamber 368 may be referred to as coagulants, quench liquids, quench coagulants, wash liquids, and rinse liquids.

In some embodiments, the chambers containing the wash liquids may have any suitable cross-section, such as, for example, circular, square, elliptical. Each chamber may be maintained at different temperature corresponding to the respective coagulation liquid. In some embodiments, each chamber may be equipped with cooling or heating jackets to control the temperature of the coagulation solution or wash liquid therein. In some embodiments, controlling the temperature of the coagulation solution and/or wash liquids may help achieve desired hollow fiber morphology. In some embodiments, the temperature of the coagulation solution and/or wash liquids may be maintained between about 0° C. and about 100° C. Particularly, the temperature of the coagulation liquids that may be maintained between about 10° C. and about 60° C., preferably about 20° C. to about 50° C. In some embodiments, a temperature gradient may be maintained within the coagulation solution and/or wash liquid.

In some embodiments, the fourth chamber 368 includes a first roller 380 and the fifth chamber 370 includes a second roller 382. Each of the first roller 382 and the second roller 382 are respectively operated by a first controller 384 located in the fourth chamber 368 and a second controller 386 located in the fifth chamber 370.

During operation, with the aid of the high-pressure nitrogen cylinder 302, the dope is supplied from the dope reservoir 304 to the first dope channel 332 and the second dope channel 336 of the spinneret 100. Simultaneously, the bore fluid is supplied from the bore fluid reservoir 306 to the bore needle 136 of the spinneret 100. Due to the distinct dope channel orientation angles, such as 30° and 45°, shear stress development in the extruded dope and bore fluid may be greatly reduced. The bore needle 136 has dual support that can stand steady-state even at a higher shear stress of bore fluid supply and flow angle of dope. The extruded dope and bore fluid membranes are spun into the coagulation container 202 for the dry/wet and wet phase inversion process. Once the immersion of the extruded fiber through the first coagulation solution "S" is completed, solvent diffusion towards the nonsolvent takes place. Spinning of the uncured fiber may be operated at speeds up to 0.5-100 m/min.

The second chamber 362 and the third chamber 364 serves to wash the hollow fiber capillaries. In some embodiments, the phase inversion in the hollow fiber may occur upon contact of the hollow fiber with the secondary coagulation liquid, or with the wash liquids contained within washing baths "W1" and "W2". In some embodiments, a contact time of the hollow fiber in each of the coagulation baths and/or washing baths may be sufficiently high to allow a desired degree of diffusion of solvent out of the hollow fiber and sufficient diffusion of coagulants into the hollow fiber. In some embodiments, the first roller 380 and the second roller 382 may be rotated by the first controller 384 and the second controller 386, respectively, at desired velocity. Thereafter, the hollow fiber may be subjected to high-intensity ultrasonic bath at desired temperature with or without external chemical to produce high quality fibers.

For additional examples of related methods and/or assemblies for spinning hollow fibers, see U.S. Pat. Nos. 5,795,920A and 6,890,435B2 as well as WIPO patent application 2016178835.

According to the present disclosure, the hollow fibers prepared may also be spun continuously. Such a continuous spinning method may be advantageous for producing high quality and consistent hollow fibers.

Figure 4:
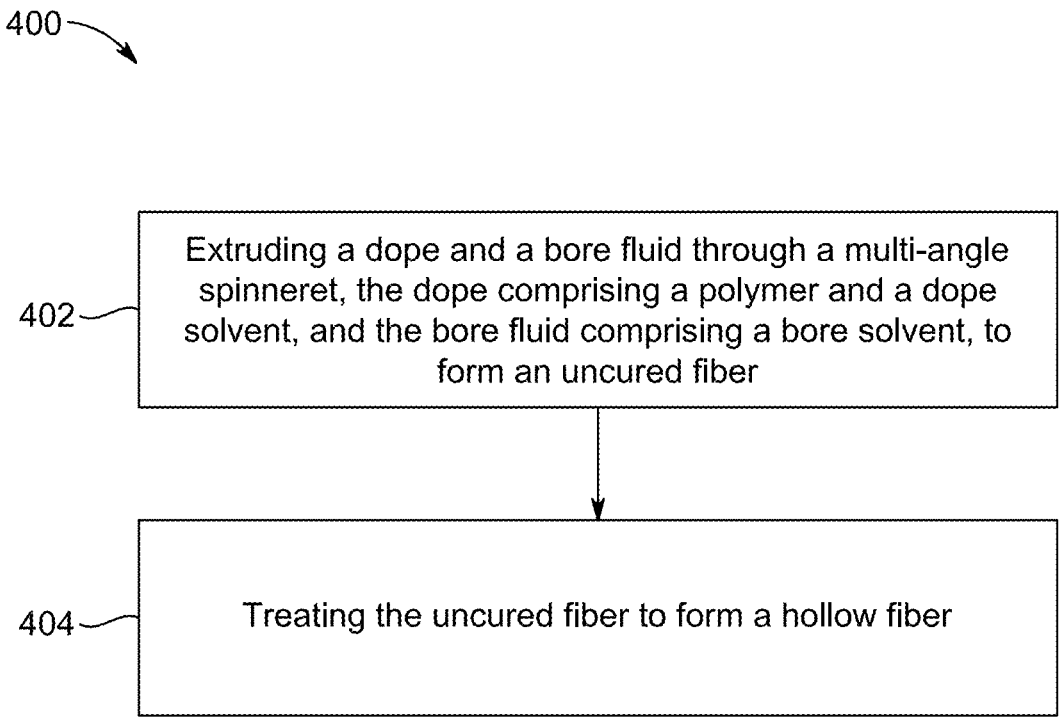
FIG. 4 illustrates a flowchart of a method of forming a hollow fiber, according to an embodiment of the present disclosure.

FIG. 4 illustrates a flowchart of a method (400) of forming the hollow fiber, according to an embodiment of the present disclosure. The method is described with reference to FIGS. 1 through 3. At step 402, the method includes extruding the dope and the bore fluid through the spinneret. The dope includes a polymer and a dope solvent, and the bore fluid includes a bore solvent to form an uncured fiber as described above. In some embodiments, an extrusion force for extruding the dope and/or the bore fluid is provided by a compressed gas as described above. In some embodiments, the dope and bore fluid are extruded through the spinneret into the first coagulation bath comprising the conical or trapezoidal coagulation bath container and the first coagulation solution as described above. In some embodiments, the first coagulation solution comprises a solvent for the polymer in the dope and an anti-solvent for the polymer in the dope as described above. In some embodiments, the dope and bore fluid extruded through the spinneret passes through the air gap between the spinneret and the first coagulation bath before entering the first coagulation bath as described above.

In some embodiments, the first coagulation solution is continuously drained from and added to the first coagulation bath, such that the volume of the first coagulation solution in the conical or trapezoidal coagulation bath container does not change during the extrusion as described above. In some embodiments, the first coagulation solution may be continuously drained from and added to the first coagulation bath, such that the composition of the first coagulation solution does not change during the extrusion as described above. In some embodiments, the first coagulation solution is circulated in the conical or trapezoidal coagulation bath container in a direction substantially antiparallel to the direction in which the dope and the bore fluid are extruded into the first coagulation bath as described above.

At step 404, the method includes treating the uncured fiber to form the hollow fiber. In some embodiments, the step of treating the uncured fibers includes ultrasonicating as described above. In some embodiments, the step of treating the uncured fibers includes washing the uncured fiber as described above. In some embodiments, the uncured fibers may be subjected to high intensity ultrasonic environment in a closed system with presence of nitrogen, hydrogen, oxygen, argon, carbon dioxide, sulphur dioxide, or methane.

As used herein the words "a" and "an" and the like carry the meaning of "one or more."

Obviously, numerous modifications and variations of the present invention are possible in light of the above teachings. It is therefore to be understood that, within the scope of the appended claims, the invention may be practiced otherwise than as specifically described herein.

EXAMPLES

An exemplary spinning condition to produce the hollow fiber membrane is provided below:

| | |
|---|---|
| Dope composition | 20 wt % PES, 5 wt % additives, 75-80 wt % aprotic solvent |
| Length of air gap | 3 cm |
| Rate of extrusion of bore fluid to dope | 1:3 $cm^3$/minute |
| Spun fiber take up speed | 3.5 m/min = [(3.5/1000 km)/(1/60 hr)] = (3.5 × 60)/1000 km/hr = 0.21 km/hr = 1.68 km/8 hrs (for 1 month ~ 240 hours, i.e., 8 hrs/day) |

Dope is fed to the spinneret at rate of 3 mL/min
= [(3/1000 L)/(1/60 hr)] = (3 × 60)/1000 L/hr = 0.18 L/hr
With 1000 spinnerets, extrusion = 180 L/hr
For 8 hrs/day, dope requirement for single spinneret is 1.44 L/8 hrs or 1.68 km

The invention claimed is:

1. A method of forming a hollow fiber, the method comprising:

extruding through a multi-angle spinneret a dope, the dope comprising a polymer and a dope solvent, and a bore fluid, the bore fluid comprising a bore solvent, to form an uncured fiber;

wherein the multi-angle spinneret comprises:

a body comprising an upper body coupled to a lower body;

wherein the lower body comprises:

a dope chamber having an upper chamber opening and a lower chamber opening;

a dope outlet connected to the lower chamber opening of the dope chamber; and wherein the upper body has a truncated triangular cross section flaring from a top end to a bottom end, and wherein the upper body comprises:

a plurality of dope channels, each comprising a dope channel inlet and a dope channel outlet, each of the dope channels being oriented at a dope channel orientation angle, each dope channel outlet fluidly connected to the dope chamber, the plurality of dope channels comprising:

a first dope channel having a first dope channel orientation angle of from 90° to greater than 75°, a second dope channel having a second dope channel orientation angle of from 52.5° to greater than 37.5°, a third dope channel having a third dope channel orientation angle of from 37.5° to 15°, wherein the dope channel orientation angles are determined in a range of from 0° to 90° from a horizontal plane defined by a top surface of the lower body that abuts a bottom surface of the bottom end of the upper body;

a bore needle channel extending from an exterior surface of the top end of the upper body to the upper chamber opening of the dope chamber, the bore needle channel comprising a bore needle connection located at a surface end of the bore needle channel and a bore needle channel termination located at a dope chamber end of the bore needle channel, the bore needle channel being oriented substantially perpendicular to a plane defined by the upper chamber opening of the dope chamber; and a bore needle comprising a bore fluid inlet and a bore fluid outlet, the bore needle connected to the bore needle connection and disposed in the bore needle channel co-axial to the bore needle channel and extending through the bore needle channel and the dope chamber such that a bore fluid flow through the bore needle is kept separate from a dope flow through the dope chamber; and the bore fluid outlet is positioned substantially within the dope outlet such that a bore fluid flow out of the bore fluid outlet is substantially coaxial with and substantially centered within a dope flow out of the dope outlet; and, then treating the uncured fiber to form a hollow fiber.

2. The method of claim 1, wherein the dope and bore fluid are extruded through the multi-angle spinneret into a first coagulation bath comprising a conical or trapezoidal coagulation bath container and a first coagulation solution.

3. The method of claim 2, wherein the dope and bore fluid extruded through the multi-angle spinneret pass through an air gap between the multi-angle spinneret and the first coagulation bath before entering the first coagulation bath.

4. The method of claim 1, wherein the treating comprises ultrasonicating.

5. The method of claim 1, wherein the treating comprises washing the uncured fiber.

* * * * *